United States Patent [19]

Herr

[11] 4,397,397

[45] Aug. 9, 1983

[54] MOISTURE TIGHT CLOSURE AND CONTAINER SYSTEMS

[75] Inventor: James E. Herr, East Petersburg, Pa.

[73] Assignee: Kerr Glass Manufacturing Corporation, Los Angeles, Calif.

[21] Appl. No.: 255,299

[22] Filed: Apr. 17, 1981

[51] Int. Cl.[3] ..... B65D 55/02

[52] U.S. Cl. ..... 215/211; 215/222

[58] Field of Search ..... 215/222, 211, 320, 355, 215/332

[56] References Cited

U.S. PATENT DOCUMENTS

| | | | |
|---|---|---|---|
| 4,027,776 | 6/1977 | Douglas | 215/355 X |
| 4,053,078 | 10/1977 | Herr | 215/222 |
| 4,200,196 | 4/1980 | Bashour | 215/320 X |

*Primary Examiner*—George T. Hall

*Attorney, Agent, or Firm*—Fitch, Even, Tabin, Flannery & Welsh

[57] ABSTRACT

A moisture proof vial and closure system are provided which may be used in a child-resistant mode or in a non-child resistant mode. In the child resistant mode locking lugs 22 on the closure are interlocked with bayonnet slots on the vial. A non-child resistant operation in a moisture proof system may be achieved by leaving the locking lugs 22 off of the closure skirt wall 20 and by adding a detenting means 51 inside of the container to engage and hold a sealing plug 39 against sliding outwardly of the container because of the lack of locking lugs on the closure 10A. A simple push inward will force the sealing plug 39 home to its sealing position to seal the medicine in the vial, and a simple pull on the closure to pull the fitment from the detenting means is needed to remove the closure. The preferred detenting means 51 is in the form of radially inwardly directed projections 52 formed on the interior container wall to abut and restrain the sealing plug against inadvertent sliding from the container. The sealing bead 50 on closure 10B is carried on sealing plug 39 which is formed on a discrete and separable fitment 40. For the closure 10A, the sealing plug 39 is integral with the top wall 18 of the closure.

5 Claims, 10 Drawing Figures

MOISTURE TIGHT CLOSURE AND CONTAINER SYSTEMS

The present invention relates to safety closures and containers and more particularly to a combination thereof which may be either child resistant or non-child resistant.

Child resistant safety closures and associated containers are known in which the container and closure have cooperative locking lugs, wherein the lugs on the container or closure will have recesses so as to require a downward and rotational movement to effect a locking or unlocking of the closure. Federal law requires medicine containers to be equipped with child resistant closures to avoid injury to curious children who seek the contents of the containers. As a result of the aforedescribed problem, containers have been developed where some type of complex movement or manipulation of the closure with respect to the container is mandated to limit the accessibility of the contents of the container to children.

For the packaging of medicines in vial type containers, today's standards require that the closure and vial container be "moisture tight" in the sense that less than 100 milligrams of moisture per day per liter of volume enter the sealed container. Herr, U.S. Pat. No. 4,053,078 issued Oct. 11, 1977, and assigned to Kerr Glass Manufacturing Corporation, describes just such a container and closure; said patent being incorporated by reference as if fully rewritten herein.

Child resistant containers, however, may pose some problems to the elderly, or to arthritic persons. For instance, arthritics may lack the capability in removing child resistant closures. The elderly, those with visual problems, and those having a low degree of physical dexterity often experience difficulty in removing child resistant closures.

It has been proposed, as disclosed in U.S. Pat. No. 3,865,267, to provide a reversible closure which has a child resistant locking mode when attached to the container in one orientation, and which when flip-flopped over to another orientation, may be attached to the container in a non-child resistant manner. Of course, it is possible for a consumer to reapply the closure in the wrong mode with the result that a child may access the medicine with this type of construction. Further, these closures are bulky and use considerable plastic.

Accordingly, a general object of the present invention is to provide an improved moisture tight container and closure system which can be either child resistant or non-child resistant.

Further objects and advantages of the present invention will become apparent from the following detailed description of the invention when taken in conjunction with the accompanying drawings wherein.

Figure 7:
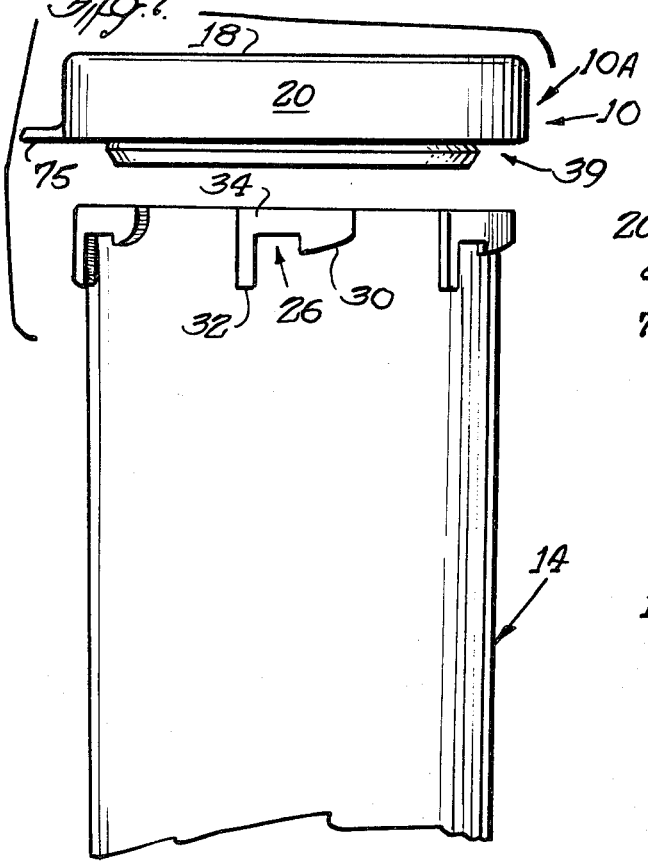
FIG. 7 is an elevational view of a closure and container system having a non-child resistant closure.

As shown in the drawings for purposes of illustration, the invention is embodied in a system having a closure indicated by a general reference character 10, and a container 14, such as a medicine vial, having an open mouth 12 at its upper end which is to be covered by the closure. The general reference character 10 for the closure is generic to a child resistant closure 10B shown in FIGS. 1 and 2 and to a non-child resistant closure 10A shown in FIGS. 7 and 8. The closure includes an upper planar, circuler top wall 18 and an integral skirt wall 20 depending from the top wall to surround the upper end of the container. The moisture tight seal is obtained by sealing plug 39 which may be constructed on a fitment 40 as disclosed fully in U.S. Pat. No. 4,053,078. The sealing plug 39 includes a central annular plug wall 48 with a sealing means 38 thereon for sealing engagement with an interior wall 58 of the container.

The illustrated sealing means 38 is in the form of a radially, outwardly-directed, annular bead 50 projecting from the small diameter plug wall 48 to abut and to be held in compression by the cylindrical container wall 58. The relaxed, or free diameter of the sealing bead is larger than the diameter of the cylindrical container wall so that the sealing bead 50 is being compressed by the wall when engaged therewith.

In the system disclosed in U.S. Pat. No. 4,053,078, the fitment sealing bead compression was insufficient to hold the fitment and closure onto the vial, and it was necessary to turn and compress the fitment's upper crown portion 42 and web 46 to position locking lugs 22 on the closure at positions to be inserted into the retaining recesses 26 on the outer side wall of the container. With the locking lugs 22 thus entered into the recesses 26, the closure and container were interlocked in the child resistant mode which required both a downward force to compress the fitment spring and a simultaneous rotation of the closure to turn the locking lugs 22 from alignment with the recesses so that the locking lugs could be passed upwardly in the space between locking lugs. It is the combination of such movements that makes the system child-resistant, but also makes it difficult for some elderly or arthritic people to open and to prefer non-child resistant closure systems.

Figure 8:
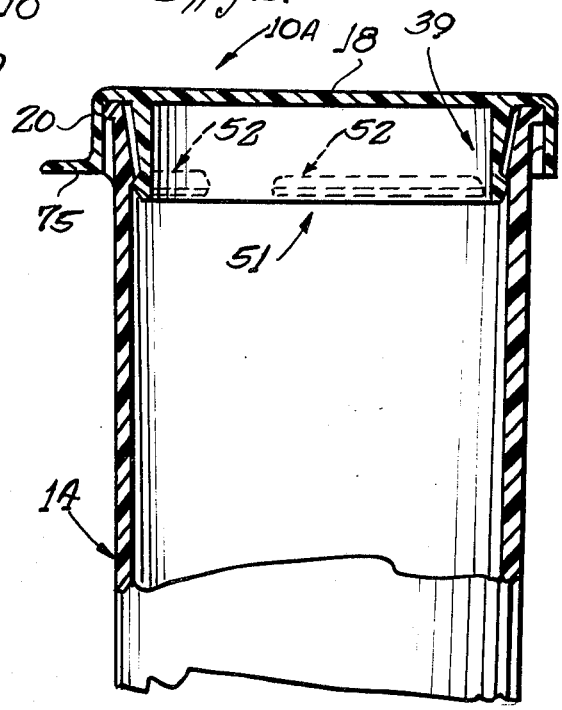
FIG. 8 is a cross-sectional view of the closure and container system of FIG. 7 with the closure being secured on the container.
Figure 9:
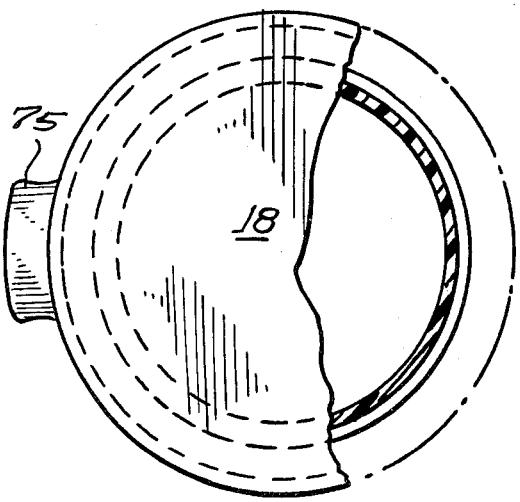
FIG. 9 is a plan view partially broken away of the closure and container system shown in FIG. 8.
Figure 10:
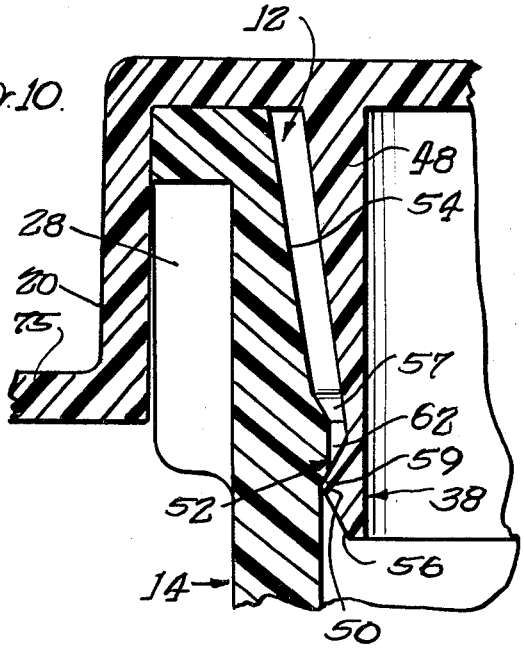
FIG. 10 is a fragmentary enlarged cross-sectional view of the closure and container system of FIG. 8.

In accordance with the present invention, a non-child resistant operation in a moisture proof system may be achieved by leaving the locking lugs 22 off of the closure skirt wall for non-child resistant closures 10A and by adding a detenting means 51 inside of the container to engage and hold the sealing plug 39 against sliding outwardly of the container because of the lack of locking lugs on the closure 10A. As best seen in FIG. 8, a simple push inward will force the sealing plug 39 home to its sealing position to seal the medicine in the vial, and a simple pull on the closure to pull the fitment from the detenting means is needed to remove the closure.

The preferred detenting means 51 is in the form of radially inwardly directed projections 52 formed on the interior container wall to abut and restrain the sealing plug against inadvertent sliding from the container. Often, women carry pill vials in their purses, and the motion of the pills in the vial would push the sealing plug from the vial, unless the closure is positively restrained.

The child resistant closure 10B may be, and as illustrated herein, is identical to the closure disclosed in U.S. Pat. No. 4,053,078. The sealing bead 50 on closure 10B is carried on sealing plug 39 which is formed on a discrete and separable fitment 40. This is in contrast to the closure 10A in which the sealing plug 39 is integrally with the top wall 18 of the closure. Also, in the closure 10B the locking lugs 22 will interlock with locking member recesses 26 on the container to hold the closure in the child resistant mode. In contrast, the closure 10A has a skirt wall 20 without any locking lugs thereon.

In both of the closures 10A and 10B, it is preferred that the portion of the sealing plug 39 being detented is the sealing bead 50. In either closure 10A or 10B, when the sealing bead 50 goes across and expands below the detent projections 52, a definite snap action is felt, thereby assuring the user that the closure and fitment are in a secured position. Preferably, the detent projections 52 are spaced in a circumferential direction from each other by spaces 61 into which the bead material may expand during the maximum compression of the sealing bead by the projections. These spaces aid in reducing the amount of force needed to push the bead down past the projections or to pull the bead up past the projections.

The preferred detent projections 52 are located adjacent the bottom portions of the locking members 28 on the container so that the sealing engagement with the cylindrical container wall is at a location below the bottom of a tapered-in surface 54 on the container's internal wall 58 and which indicates the bottom of the molded portions forming the locking lug recesses 26 in the container.

To assist in sliding the sealing bead 50 past the detent projections 52, they are preferably provided with upper and lower inclined camming surfaces 57 and 58. The upper camming surface 57 is inclined inwardly and downwardly to gradually cam the compressed sealing bead 50 to a smaller size until it passes the inner rim surface 62 on the detenting projections. For a similar reason, the camming surface 59 are directed radially inwardly and upwardly from their lower edges at the container wall 58 to their juncture with the inner rim surface 62 on the projections.

Typically, a druggist is provided with a large supply of the closures 10B for locking in the child resistant mode with a container. The druggist will also be provided with a small number of non-child resistant closures 10A. The person requesting a non-child resistant system will be given a vial with a closure 10A which does not have the locking lugs 22. All others will be given the closure 10B having locking lugs 22 for locking in the recesses 26 to make the system child-resistant. The same container 14 is used with either of the closures 10A or 10B.

Referring now is greater detail to the closure 10B constructed in accordance with the present invention, it has a plurality of locking members in the form of locking lugs 22, of which there are six in the illustrated embodiment, formed on and projecting radially inwardly from the inner surface of the skirt wall in circumferentially equidistantly spaced relation thereabout. The locking lugs 22 are spaced below the upper cap wall 18 and are cooperable with complementary locking members in the form of recesses or grooves 26 defined by projections 28 formed on the upper open end 12 of container 14 so as to releasably mount the closure 10B onto the container. The illustrated closure 10B has six lugs to hold the closure in a locked position.

Figure 1:
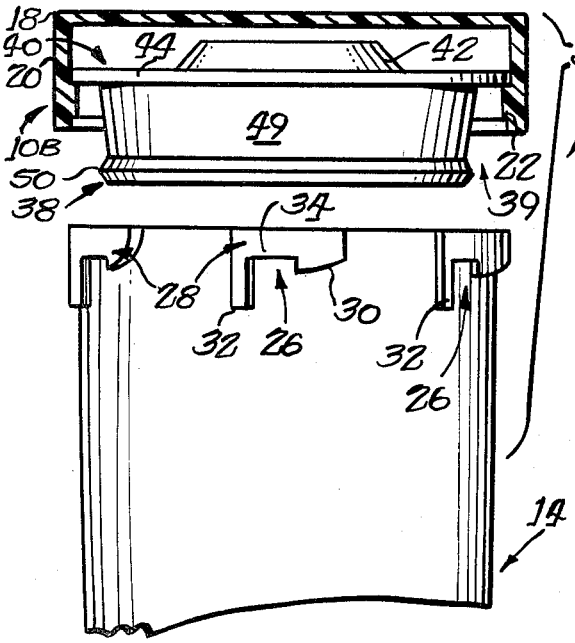
FIG. 1 is a partial elevational view, portions being shown in longitudinal section, illustrating a closure and container system wherein the closure is a child resistant closure and constructed in accordance with the preferred embodiment of the invention.

With particular reference to FIG. 1, each of the retaining recesses 26 on the container 14 opens downwardly toward the bottom of the container. In mounting the closure 10B on the container 14, it is brought to a position wherein the locking lugs 22 can move downwardly onto the container 14 between the projections 28. When the closure 10B is moved downwardly over the container and simultaneously rotated, the locking lugs 22 slide along the cam wall 30 into recesses 26. In the embodiment shown, the recesses are defined by the projections on the container. This may be reversed, however, with locking lugs formed on the container and the recesses formed in the skirt wall of the closure 10A.

To provide a moisture tight seal between the closure 10 and the container 14 to substantially exclude the intrusion of moisture vapor to levels equal to or less than U.S. government standards, each of closure 10A and 10B is formed with a sealing means, indicated generally at 38, adapted for engagement with the internal wall of the container at a distance axially downward from the open mouth end 12 to just below the detent projections 28 as will be discussed in more detail below. The sealings means 38 for the closure 10B is on the separate fitment 40 of a plastic material having greater flexibility than the plastic material used for the skirt wall and top wall of the closure. Preferably, the fitment 40 is made of a low-density polyethylene, or other suitable plastic, which has good moisture barrier properties and flexibility, and is formed as a unitary member by conventional molding or other suitable manufacturing techniques.

The fitment 40 includes a generally planar circular crown portion 42 which is formed integral with an annular flange 44 through an interconnecting annular transverse V-shaped web 46 such that the plane of the crown 42 is disposed above the plane of the annular flange 44 a predetermined distance, as will become more apparent below.

The fitment 40 includes a downwardly depending annular wall 48 formed integrally at its upper end with a lower surface of the annular flange 44 adjacent the V-shaped web 46. The annular wall 48 has a frustoconical outer peripheral surface 49 which terminates at its lower edge in the radially outwardly directed circumferential sealing bead 50 formed adjacent a lower annular edge surface 52 of the wall 48.

Figure 2:
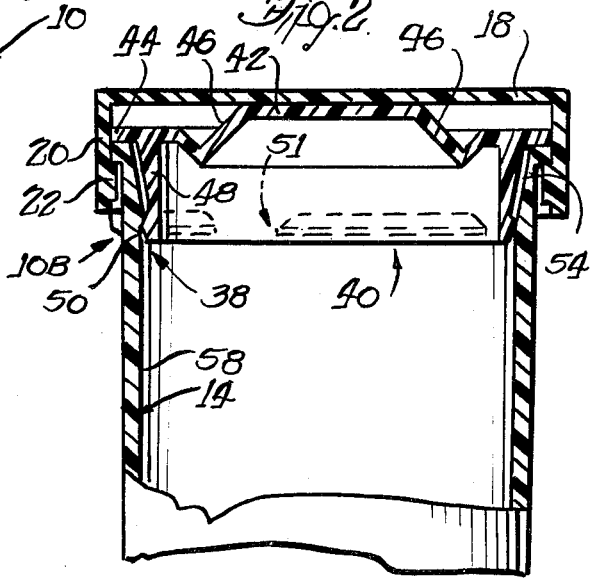
FIG. 2 is a partial elevational view, portions being shown in longitudinal section illustrating a closure and container system of FIG. 1.
Figure 3:
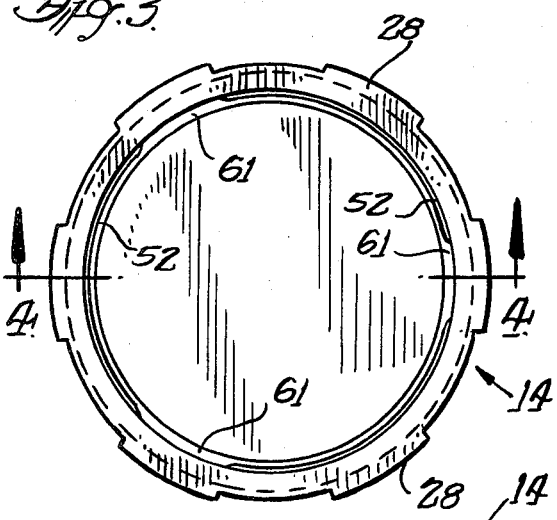
FIG. 3 is a plan view of the container.
Figure 4:
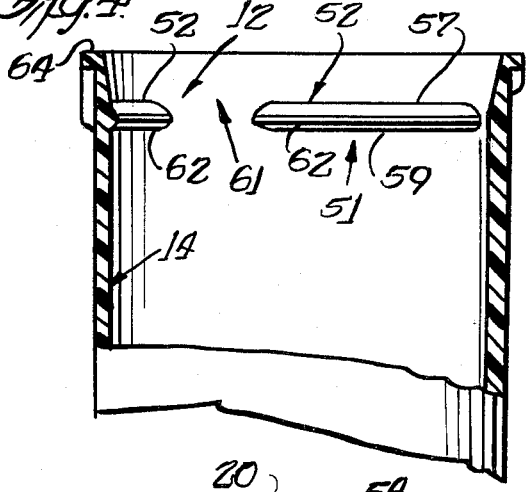
FIG. 4 is a partial sectional view of the container taken along the line 4—4 of FIG. 3.
Figure 5:
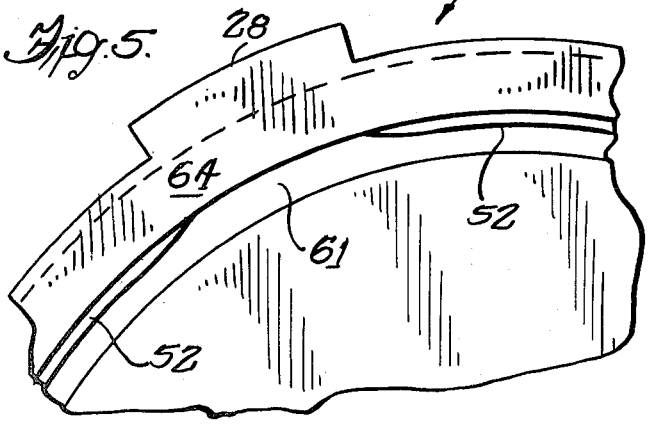
FIG. 5 is an enlarged fragmentary plan view of a portion of the container.
Figure 6:
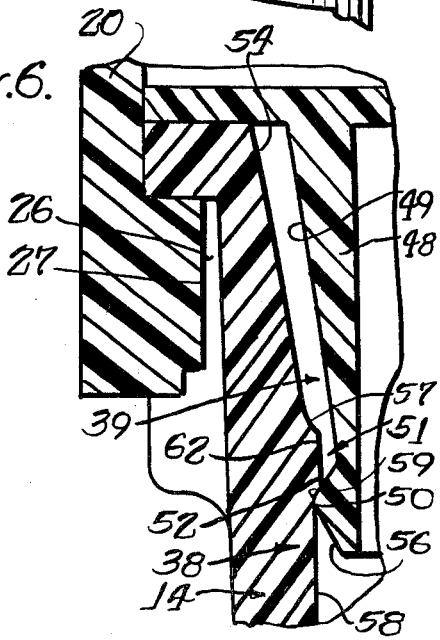
FIG. 6 is a fragmentary enlarged cross-sectional view of the closure and container of FIG. 2.

The fitment 40 is formed so that the annular flange 44 has an outer diameter greater than the diameter of the innermost surfaces of the radially inwardly projecting locking lugs 22 on the closure 10B so that the fitment may be inserted within the closure 10 and retained by the lugs 10, as shown in FIG. 2. As seen in FIG. 1, the fitment crown 42 is spaced above the plane of the annular flange 44 a distance less than the axial spacing of the lugs 22 below the upper wall 18 of the closure. The crown 42 of the fitment is formed to lie above the plane of the flange 44 by a distance sufficient to effect compression of the crown 42 against the upper wall 18 of the closure 10 when the closure is mounted on the container with the locking lugs 22 of the closure 10B disposed within the retaining notches 26. The compression force exerted by the crown of the fitment against the upper wall of the closure biases the locking lugs 22 upwardly against the upper bridges 34 which define the upper edges of the retaining notches 26. With the closure 10B thus applied, the bead 50 will be below the detent projections 52. In contrast, in the closure 10A, when the bead 50 on the closure 10A is shoved downwardly past the detent projections 52 and is released there is no spring force from any fitment spring trying to urge the sealing bead 50 upwardly past the detent projections 52. The distance from the underside of the cap top wall 18 to the upper edge of the sealing bead 50 is chosen to keep the closure 10A on tight without rattling and with the rim of the container abutting the underside of the cap top wall 18. Thus, the closure 10A is held onto the container by the sealing bead 50 engaging the lower camming surface of the detent projections 52.

The lead-in surface 54 is particularly useful in applying a closure 10 to the container in that the sealing bead 50 has a smaller than the diameter of lead-in surface 54 at diameter top end of the lead-in surface, and hence, the bead need not be precisely centered to fit therein. Thus, the sealing bead will be centered automatically by the tapered lead-in surface as the bead 50 moves downwardly therealong. An inclined lower edge 56 on the bead 50 which inclines radially inwardly below the bead facilitates the camming and centering of the sealing plug into a properly centered position to slide down the lead-in surface. This will facilitate automatically applying the closures to the containers with automated equipment.

The thickened cross section for the bead 50 assures that the bead is relatively stiff to assume and maintain a circular configuration in contact with the wall and will not be displaced into an oval or other configuration which would allow gases and moisture to enter. Also, the thickened cross section with the tapered surface 56 prevents wear or damage to this lower sealing end of the sealing plug whereas, in contrast, a very thin sealing end may be damaged by abutting the container rim and the detent projections 52 after reusage and lose its sealing capability.

As stated in U.S. Pat. No. 4,053,078, the sealing bead 50 is adapted to engage the interior surface of the container at a location axially below any out-of-round surface within the neck of the container. In accordance with the illustrated embodiment, the sealing bead 50 is formed to engage the internal surface of the container neck generally adjacent, and preferably axially below the lower ends of the long stop wall portions 32 of the radial projections 28, and below the detent projections 52, and hence, below any recesses or indentations in the internal surface of the container wall formed, as described above, by differential cooling of the plastic container wall at the location of these thicker cross-sectional portions of the container. It has been found that such depressions act as channels or openings through which moisture vapor may pass in sufficient quantities to prevent attaining of the desired moisture tight standards.

As noted in the embodiment of FIG. 1, the lower ends of the projections 52 terminate at substantially the same axial location as the lower edge of the lead-in surface 54. The sealing bead 50 is sized to have a slightly larger diameter than the internal cylindrical diameter of the container's cylindrical wall 58 so that the sealing edge is compressed radially inwardly by the wall 58 at a location below the lead-in surface and below the locking projections 52. In manufacturing plastic and glass containers having configurations as described in respect to the container 14, that is, having locking recess projections 28 formed circumferentially thereabout adjacent the upper open ends thereof, and particularly when manufacturing such containers on a mass production basis, the upper annular surface, as indicated at 64 on the container 14, may not be planar within close dimensional tolerances. As a result, when a closure 10B having a fitment 40 is mounted on the container with the annular flange 44 of the fitment engaging the upper edge 64 of the container, a moisture tight seal between the fitment flange 44 and the upper edge of the container is not accomplished.

It is also a common practice in manufacturing containers such as the container 14 by molding to provide one or more vent grooves in the upper annular edge 64 to allow escape of gas during molding. The vent grooves prevent full circumferential sealing contact between the fitment flange and the upper edge of the container neck. While the upper edge of the container neck could be machined to eliminate the grooves, the added machining adds to the manufacturing costs. In the closure 10A the undersurface of the closure top wall 18 abuts the container's annular edge but does not seal against the same because of the vent grooves in the top edge 64.

The preferred closure 10A is molded on a flexible plastic material such as low-density polyethylene plastic which allows it to be used as a "snap cap". More specifically, the preferred non-child resistant closure 10B acts as a "snap cap" in that the thumb may be used to lift and bend the side of the cap to cause it to lift from the container. This snap action may be aided by adding a thumb tab 75 (FIG. 8) to the skirt wall 20, Herein, the thumb tab 75 is integrally attached to the lower edge of the skirt wall and projects normal and outward therefrom and extends circumferentially for about 30 degrees; has a thickness of 0.050 inch; and, projects outwardly about 0.366 inch from the skirt wall. The thumb tab also helps identify the non-child resistant closures so that they may be readily distinguished from the child resistant closures that do not have such a thumb tab and which are not snap caps.

From the foregoing it will be seen that both of the closures 10A and 10B have the annular sealing bead 50 forming a moisture tight seal with the container internally of the open mouth thereof below any lead-in surface thereon. The need for a true planar upper edge 64 on the container is eliminated. In the closure 10A, the sealing bead 50 also abuts the undersides of the detent projections 52 and is thus held onto the container although the system is a non-child resistant system. For the closure 10B, the locking lugs 22 on the closure are interlocked with the locking member recesses 26 to hold the closure 10B in a child resistant system.

Thus, in accordance with the present invention, a container is provided which is suited to receive either a closure 10A or 10B which, when associated with the container, gives a moisture tight seal with the container where the container can be readily opened and resealed with the closure. The invention permits a druggist to carry a single inventory of containers and separate inventories of child resistant closures 10B and non-child resistant closures 10A. Depending on the preference of the consumer, the druggist will select the appropriate closure 10A or 10B for use with the container 14 which accommodates either closure.

While a preferred embodiment of the present invention has been illustrated and described, it will be obvious to those skilled in the art that changes and modifications may be made therein without departing from the invention in its broader aspects. Various features of the invention are set forth in the following claims.

What is claimed:

1. A closure and a container having a moisture tight sealing engagement with each other, said closure being either a child resistant or non-child resistant closure, comprising:

a container having a side wall, an upper end with an open mouth over which said closure is received, and locking members on said container adjacent said upper end;

an interior wall on said side wall of said container having detent projections extending inwardly into the hollow interior of the container, ends on the detent projections being spaced from one another in a circumferential direction and to define spaces between adjacent projections;

a closure having a top wall adapted to extend across the mouth of said container and a depending skirt wall, a sealing plug extending downwardly from said top wall and having a depending wall for insertion into said open mouth of said container;

said depending wall having an outwardly projecting annular sealing surface, the annular sealing surface having a diameter substantially larger than an inner diameter defined by the projections, portions of the annular sealing surface expanding into the spaces between adjacent projections as the sealing surface is being pushed down past the projections or is being pulled upwardly past the projections, said sealing surface extending below said detent projections to hold said closure onto said container and to engage said interior wall below said projections to provide a moisture tight sealing engagement of said closure with said container, said projections holding the closure on the container.

2. A closure and container in accordance with claim 1 in which the projections are located adjacent the lower ends of locking members on the container so that the sealing engagement is located below the lower ends of the locking members.

3. A closure and container in accordance with claim 1 in which the closure is a one-piece closure with the sealing plug integral with the top wall.

4. A closure and container in accordance with claim 1 in which the sealing plug and top wall are separately formed members, and in which the skirt wall of the closure has locking members thereon to interlock with the locking members on the container.

5. A container for use with a non-child resistant closure having a sealing plug comprising:

a body formed of a plastic material having an internal cylindrical wall for sealing engagement with the closure plug, said body having an open upper end;

a tapered lead-in surface at the upper end of said container having a larger upper diameter and a smaller lower diameter;

a plurality of locking members formed on the exterior of said body adjacent the open upper end of said body for locking engagement with locking members on a closure; and a detent means having a plurality of inwardly directed projection means projecting radially inwardly from said interior wall at spaced circumferential locations on said interior wall for detenting engagement with a portion of the closure, said projections being located axially below said lead-in surface.

* * * * *